US008365947B2

(12) United States Patent
Solomon

(10) Patent No.: US 8,365,947 B2
(45) Date of Patent: Feb. 5, 2013

(54) BEVERAGE SLEEVE FOR A CONTAINER

(76) Inventor: Merrill Solomon, Potomac, MD (US)

( * ) Notice: Subject to any disclaimer, the term of this patent is extended or adjusted under 35 U.S.C. 154(b) by 9 days.

(21) Appl. No.: 12/509,070

(22) Filed: Jul. 24, 2009

(65) Prior Publication Data

US 2010/0018984 A1 Jan. 28, 2010

Related U.S. Application Data

(60) Provisional application No. 61/083,746, filed on Jul. 25, 2008.

(51) Int. Cl.
*B65D 25/20* (2006.01)
*G09F 3/00* (2006.01)

(52) U.S. Cl. ..... 220/739; 40/306; 40/310; 220/738

(58) Field of Classification Search ..... 220/739, 220/737, 738; 215/386, 392, 394; 40/306, 40/310; D7/624.2
See application file for complete search history.

(56) References Cited

U.S. PATENT DOCUMENTS 2,001,371 A * 5/1935 Thoke ..... 426/132
2,214,436 A * 9/1940 Painter ..... 24/1
2,932,423 A * 4/1960 Baumgartner ..... 220/737
4,658,974 A * 4/1987 Fujita et al. ..... 215/12.2
5,857,615 A * 1/1999 Rose ..... 229/403
6,286,798 B1 * 9/2001 Chun ..... 248/311.2
6,557,751 B2 * 5/2003 Puerini ..... 229/402
6,814,253 B2 * 11/2004 Wong ..... 220/739
7,000,801 B2 2/2006 Rodriguez
D524,118 S * 7/2006 Gregorczyk ..... D7/624.2
2004/0232157 A1 * 11/2004 Smith ..... 220/739
2005/0103795 A1 * 5/2005 Hall et al. ..... 220/737
2005/0173445 A1 * 8/2005 Sumerson et al. ..... 220/737
2005/0258179 A1 * 11/2005 Morrison ..... 220/737
2009/0100726 A1 * 4/2009 Regas ..... 40/310
2009/0283537 A1 * 11/2009 Silverstein et al. ..... 220/737

* cited by examiner

*Primary Examiner* — Mickey Yu
*Assistant Examiner* — Niki Eloshway
(74) *Attorney, Agent, or Firm* — Oblon, Spivak, McClelland, Maier & Neustadt, L.L.P.

(57) ABSTRACT

An infinitely variable diameter beverage sleeve includes a first surface configured to contact the container and extend around a circumference of the container, and a second surface configured to extend around the circumference of the container and face away from the container, and a securing device to hold the sleeve to the outside surface of the container. A first portion of the securing device is provided on one end of the sleeve on the first surface, and a second engaging portion of the securing means is provided as the second surface of the sleeve. The top edge of the sleeve is non-planar and the bottom edge of the sleeve is formed of a plurality of segments with at least two segments having a different radius of curvature.

15 Claims, 2 Drawing Sheets

BEVERAGE SLEEVE FOR A CONTAINER

CROSS REFERENCE

This application is a utility of and is based upon and claims the benefit of priority under 35 U.S.C. §119(e) for U.S. provisional application No. 61/083,746, filed Jul. 25, 2008, the entire contents of each which are incorporated herein by reference.

BACKGROUND

1. Field

This invention is directed to a beverage sleeve that is placed on the outside of a drink container that can protect a consumers hand from heat, cold and/or wetness of the drink and also provide a comforting feel when holding the container.

2. Description of Related Art

Many companies such as Starbucks, McDonalds, Dunkin-Donuts, etc. give their customers thermally insulating sleeves to fit over their coffee cups in order to help shield their customer's hands from the temperature of their coffee, which can be approximately 200 degrees Fahrenheit. In the related art, those sleeves typically have the name of the Company selling the coffee, i.e., Starbucks, McDonalds, Dunkin-Donuts printed on the outside of the sleeve. However, because the coffee was sold in the controlled environment such as the company store, the only brand of coffee that is sold is the company's brand, and the taste of that coffee maybe the reason the customer came into the store in the first place. As such, the sleeves are not used as an advertising vehicle to try to persuade a customer to buy anything; they are used solely to protect the customer's hands.

In the related art, beverage sleeves have been sold that have variable diameters. As discussed in U.S. Pat. No. 7,000,801, a pivoting lever structure is provided that interconnects a first and second side wall sheet ends to define a lever tab portion. In order to increase the diameter of the beverage sleeve, the lever is pivoted toward the first side wall to space the first and second side wall sheet ends apart from each other. When a smaller diameter is desired, the lever is pivoted towards the second side wall to cause the second side wall to overlap the first side wall. As such, a complex and relatively expensive system is taught in the related art in order to provide a beverage sleeve to fit a container. As shown in the related art, the container sleeve is designed to fit around a soda can that typically has a circumference with a constant radius.

However, not all containers have the same shapes and/or sizes. For example, a pint glass will have a smaller diameter at the bottom and a larger diameter at the top. The shape of the beverage sleeve becomes very important since the flared aspect of most glasses, and all cups, introduce a challenge that must be overcome if one beverage sleeve is to fit snuggly around both a parallel, and a flared, sided container, and for the advertising printed thereon to appear easy to read. The design problem becomes even more complicated and compounded when one adds to the parallel sided, verses flared sided, problem, that drink containers also come in many different diameters. The related art discussed above does not appreciate or address these issues.

SUMMARY

A beverage sleeve according to one or more embodiments of the invention, can provide a better insulating function for containers of various sizes than beverage sleeves of the related art. In addition, the beverage sleeve of the present invention can also be used as an effective advertising delivery vehicle in the uncontrolled environment of for example, a bar, restaurant, sporting event, or a convention by maintaining the advertising in a visually effective location regardless of the type of container the beverage sleeve is wrapped around.

In a bar or restaurant, point of sale type advertising can be very important. For example, once a spirit is poured from the bottle, or the beer is dispensed from the draft spout, typically no one knows what is in the glass except for the purchaser. However, the beverage sleeve according to embodiments of the invention now gives an advertiser an opportunity to take advantage of that fact and to place advertisements on that container. In this way, the advertisements on the container can generate more sales for the advertised brand no matter what particular product in actually held in the container. This is the reason why several of the large beer producers are today giving away, or subsidizing, glasses with their logos on them to restaurants and bars. Beverage manufactures appreciate that every time a glass or a drink-sleeve is used, regardless of what beverage is in that glass, the logo on that glass or drink-sleeve would be the one every one sees.

For a bar or restaurant, if they wanted to stay neutral relative to brands, but wanted to offer their customers the protection and comfort that a beverage sleeve offered, and advertise their establishment, they could give away beverage sleeves with their name on it, and suggest that the customer take it home for reuse. In a further example, a restaurant can include nightly food and/or drink specials or happy hour times and prices without placing such information on a stand that will take up room on a customer's table. As a further example, a bar can advertise a monthly schedule of events such as performance times and dates for upcoming live entertainment.

A further example of uses for the beverage sleeve is for use at a sporting event, convention, concert, etc., and in any situation to deliver brand reinforcing advertising. For example, at a football stadium such as FedEx field with 90,000 seats, all drinks, whether soft drinks or alcoholic drinks could be sold with "FedEx" on the sleeve. The customer could be told that after they finish the drink, they should take the sleeve home with them and use it in the future. At a convention the beverage sleeve could be used to reinforce a brand in a general way i.e., printing SONY on a sleeve and giving it away to all attendees at the Consumer Electronics Show in Las Vegas that typically draws approximately 150,000 people. Even further, the beverage sleeve could be used by party planners as an integral part of some celebration, weddings, birthdays, Bar Mitzvahs, etc. (i.e., Happy Birthday John).

Accordingly, a beverage sleeve according to embodiments of the invention provides the useful functionality of protecting a customer's hands from the heat of a hot drink or the icy cold and wetness of a cold drink. As such, the customer's hands are kept at a comfortable temperature and dry. The sleeve keeps a hot drink hotter longer, and/or a cold drink colder longer in addition to having a luxurious feel.

The beverage sleeve of one or more examples of this invention can be made from any material. As an example, the sleeve can be made from recyclable paper substrate. The beverage sleeve is relatively inexpensive so as to be disposable i.e., used only once and thrown away, yet it is durable enough to be used many times so it can be given away as a can or bottle "cooler" if so desired.

Because there are many different size glasses used in restaurants and bars, an advantageous feature of the beverage sleeve of the invention is that it incorporates a unique variable size capability that allows the advertising to be maintained at an effective reading position. That is, as discussed above, a beverage sleeve of the related art can be made through a series of pivoting motions which is more complex than necessary. In contrast, exemplary embodiments of this invention provide a beverage sleeve less complex in design than the related art, yet at the same time yielding a product that has infinite variability of diameters, not just two. In this way, the beverage sleeve of the present invention can protect the consumers hand as well as provide an effective device to deliver advertising to the consumer and others.

In an example of the invention, the size of the beverage sleeve can be variable in order to fit around a glass or container of any size or shape. In a further example, the beverage sleeve can be of a fixed diameter. In either sized embodiment of the invention, the beverage sleeve can be produced so that it can economically accommodate, under all circumstances, all glass sizes, all paper or plastic cup sizes, and all shapes and sizes of cans or bottles.

In one or more embodiments of the invention, the beverage sleeve is wrapped around the drink container and fastened with a securing device. As an example, a securing device could be hook and loop material, such as VELCRO™. VELCRO consists of two layers: a "hook" side, which is a thin film covered with tiny hooks, and a "loop" side, which is covered with even smaller and "hairier" loops. When the two sides are pressed together, the hooks catch in the loops and hold the pieces together.

In addition to the above exemplary advantages, the beverage sleeve of the invention detailed herein can perform the useful function of a point of sale advertising delivery vehicle. That is, because a Beverage Sleeve serves the very useful thermal insulting and wetness protection function it is viewed as a solution to a problem, not just another way to force people to view advertising. However, because the beverage sleeve has advertising printed on it, it none-the-less is a very effective way to deliver that advertising to the consumer or other target audience and increase brand recognition.

In one or more embodiments of the invention, when the beverage sleeve is fitted around a container, the letters of the advertising printed on them are maintained at a reading position substantially as provided before the beverage sleeve was wrapped around the container. For example, if advertising is provided at a set angle with respect to a bottom edge of the sleeve, when the sleeve is fitted to any container, the advertising will be maintained at substantially the same angle regardless of the size and/or shape of the container.

In a further example of the invention, advertising can be provided at varying angles on different parts of the beverage sleeve. In this way, the advertising can be viewed at different angles depending on where the advertising will be located when the sleeve is wrapped around the container.

In further examples of the invention, the top and bottom edges of the beverage sleeve can have a curved edge.

In one embodiment, a top edge of the beverage sleeve includes a substantially continuous curve from a first side edge to a second side edge.

In a further embodiment, a bottom edge of the beverage sleeve does not have a single continuous curve. Instead, the bottom edge includes a plurality of different regions with at least two regions having different curved portions.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as nonlimiting examples of the invention. In the drawings.

DETAILED DESCRIPTION OF THE PREFERRED EMBODIMENTS

Figure 1:
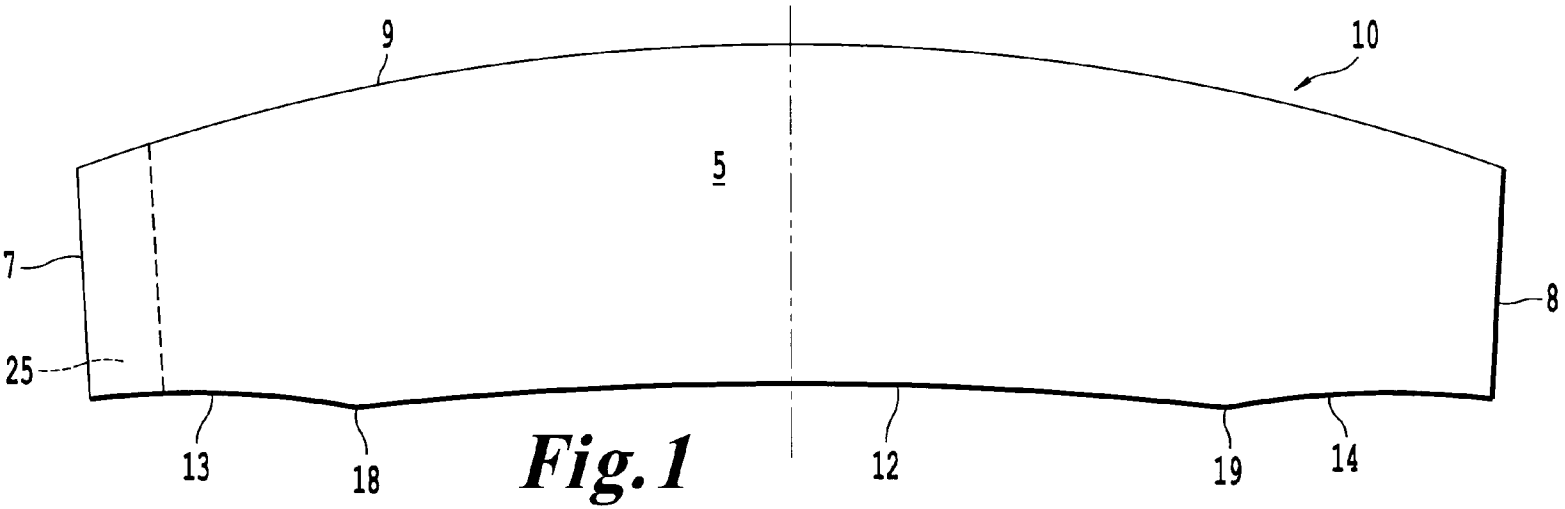
FIG. 1 is a schematic front view of a beverage sleeve according to an example of the present invention.

Reference will now be made in detail to the present preferred embodiments of the invention, examples of which are illustrated in the accompanying drawings. Wherever possible, the same reference characters will be used throughout the drawings to refer to the same or like parts.

Generally, there are two basic types of drinking containers. The first type of container essentially has substantially parallel sides. These type containers include most bottles and cans such as a soda can, and some glasses. The second type of a container is one whose sides are slightly flared out at the top. That is, the diameter of the container is larger at the top, than it is at its base. This type of container includes just about all plastic and paper cups as well as glasses, such as pint glasses most frequently used in bars to serve beer from a tap. Both the first and second type of container can come in many different diameters.

If all drink containers had parallel sides the design of the beverage sleeve could just be shaped like a rectangle when unwrapped and then it could wrap around any container. However, as discussed above, containers have different shapes and even similarly shaped containers can come in different sizes. Accordingly, a beverage sleeve according to one or more embodiments of the invention will fit both a parallel sided and a flared top container. The beverage sleeve of embodiments of the invention can fit snuggly around all containers without slipping up or down on the container. Further, when the container with the beverage sleeve is resting on a support surface, such as a table, the advertising letters printed on the sleeve will appear as desired, such as perpendicular, parallel or at an angle with respect to the support surface.

Accordingly, as shown in FIG. 1, a beverage sleeve can be provided that securely attaches to containers of all shapes and sizes, for example different lengths, widths, thicknesses. In the example of FIG. 1, the beverage sleeve 10 in this unwrapped position is stretched out and laid flat. The largest width of the beverage sleeve 10 is located in a middle portion 5 of the sleeve. In one example of the invention, the middle portion 5 can have a width of approximately 2¾". However, any smaller or greater width can be provided for the middle portion, for example 2½" or 3", without departing from the spirit and scope of the present invention. The smallest width is located on both ends or side edges of the sleeve 7, 8. In one example the side edges 7, 8 are approximately 1⅞" in width but can have a smaller or larger size. In a further example, the side edges 7, 8 have different width from each other. In an example of the invention a distance between the side edges 7, 8 is approximately 12". Such a distance provides a beverage sleeve with the appropriate size to wrap around containers of a plurality of sizes. In an example of the invention, the beverage sleeve 10 can be ⅛ or 3/16 inches thick. But it should be appreciated that any desirable size of the various dimensions of the sleeve are contemplated by embodiments of the invention depending on the desires of the producer and depending on the type of advertising requested.

As shown in FIG. 1, a top edge 9 of the beverage sleeve is formed with a substantially constant radius of curvature. The radius of curvature could be for example, 18". Due to the constant radius of curvature from one end of the sleeve to the other end, the beverage sleeve will fit snugly and securely to the container and the advertising, discussed in more detail later, can be seen in a readable manner.

In an example of the invention, the bottom edge of the beverage sleeve is not formed with a constant radius of curvature. For example, a central region 12 of the bottom edge has a first radius of curvature, for example of approximately 34½", while side regions 13, 14 of the bottom edge have a different radius of curvature, for example a radius of curvature of 22". It should be appreciated that the side regions 13, 14 can have a different radius of curvature from each other. Further, it should be appreciated that the central and side regions can have the same radius of curvature. However, one or more embodiments of the invention can have larger or smaller radii of curvature without departing from the spirit of the invention.

In one example, from an approximate middle line 18 of the length of the beverage sleeve 10, the central region 12 extends about 3½" in each direction until it reaches the beginning of a side region 13, 14. That is, at each end of the central region 12, due to the radius of curvature, the end points 18, 19 extend away from a main body of the beverage sleeve 10. Further, at the beginning of each side region 13, 14 adjacent the central region 12 at points 18, 19, the side regions 13, 14 extend away from the main body. As such, a wide portion of the beverage sleeve is created at points 18, 19 which gradually narrows towards the edges 7, 8. Due to the above configuration, the beverage sleeve 10 snugly fits around any sized/shaped container. Additionally, the overlapping portions of the bottom edges of the side regions 13, 14 of sleeve 10, shown in FIGS. 3-4 can be provided substantially parallel to each other providing a secure comfortable feel for the user gripping the beverage sleeve and container.

The side regions 13, 14 extend approximately 2½" before reaching the side edges 7, 8. In one example, the side regions 13, 14 have different lengths than each other. Further, the central region 12 and side regions 13, 14 can have any desirable size for example smaller or larger dimension. In a further example, the central and side region(s) can have the same size.

Figure 2:
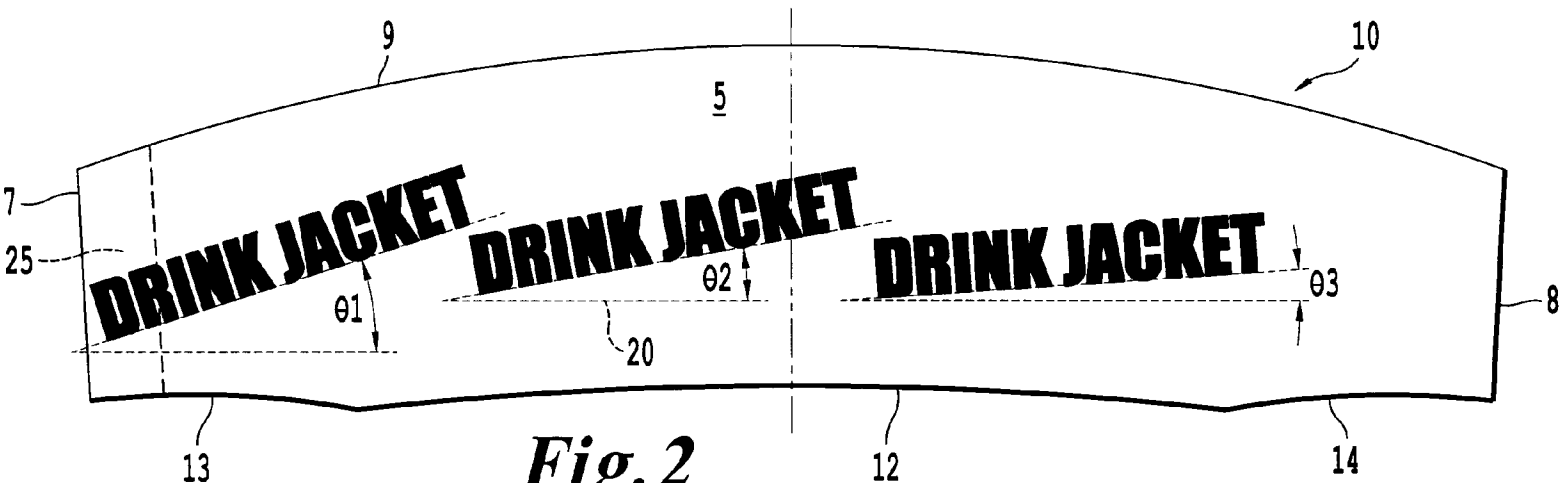
FIG. 2 is another example of a front view of a beverage sleeve according to the invention.

As shown in FIG. 2, the advertising lettering can be placed along any location of the length and width of the beverage sleeve that will be visible to the user and others. As an example of the invention, the advertising, whether it is formed of words and/or images, can be provided a plurality of times at various locations and can be located on the front and/or back of the beverage sleeve. For example, advertising can be placed side by side extending along the length of the beverage sleeve 10 and/or can be placed above and below each other in a width direction of the beverage sleeve 10.

In the example of FIG. 2, each of the three phrases of "drink jacket" can be provided at a same or different angle from each other with respect to a generally horizontal line 20 that extends along a longitudinal direction of the beverage sleeve 10. In the example of FIG. 2, each of the phrases is provided at an angle different from the remaining phrases. For example, angle θ1 can be approximately 17 degrees, angle θ2 can be approximately 10 degrees and angle θ3 can be approximately 3 degrees. However, the θ1-θ3 can be varied to any desirable degree such as forming one or more of the phrases at 0 degrees and/or at 90 degrees with respect to the horizontal line 20 so that the phrase can be substantially horizontal or vertical when viewed by a consumer. Alternatively, the one or more phrases can be provided at a negative angle θ so that the phrase extends below the horizontal line 20. It should be appreciated that any angle can be provided to orient the lettering and/or images as desired by the advertiser so that it has the desired impact on the consumer and others viewing the beverage sleeve 10.

In one embodiment, the beverage sleeve 10 is made from two easily acquired commercially available materials; 1) industrial grade ⅛ inch thick (or thicker or thinner) closed cell foam that can be used as a packing material for example, and 2) low profile locking material such as VELCRO, or VELCRO like material, which has been used on for example disposal diapers.

With respect to the closed cell foam material as the base material, the beverage sleeve inherently acquires a very cushiony, luxurious feel, and a superior thermal and wetness insulation capability compared to other material. With respect to using VELCRO, the easiest way to ensure that the beverage sleeve maintains as uniform a fit around the container as possible, whatever the container is, and whatever the size of container is, is for one part of the two piece VELCRO locking technology to be fully exposed to the other piece.

Figure 3:
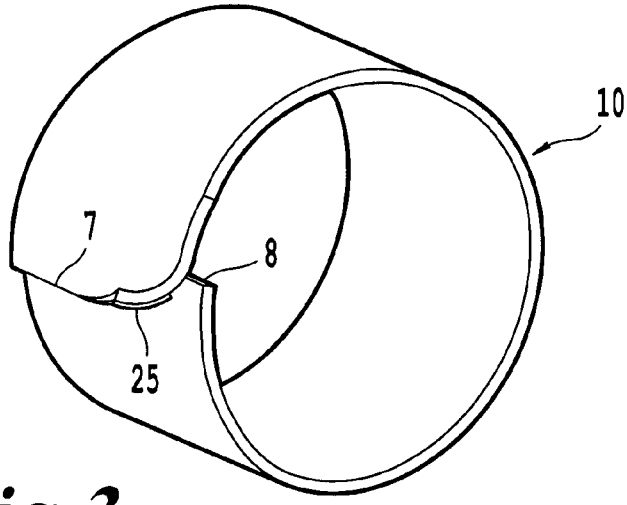
FIG. 3 is a top view of a closed beverage sleeve according to an example of the invention.
Figure 4:
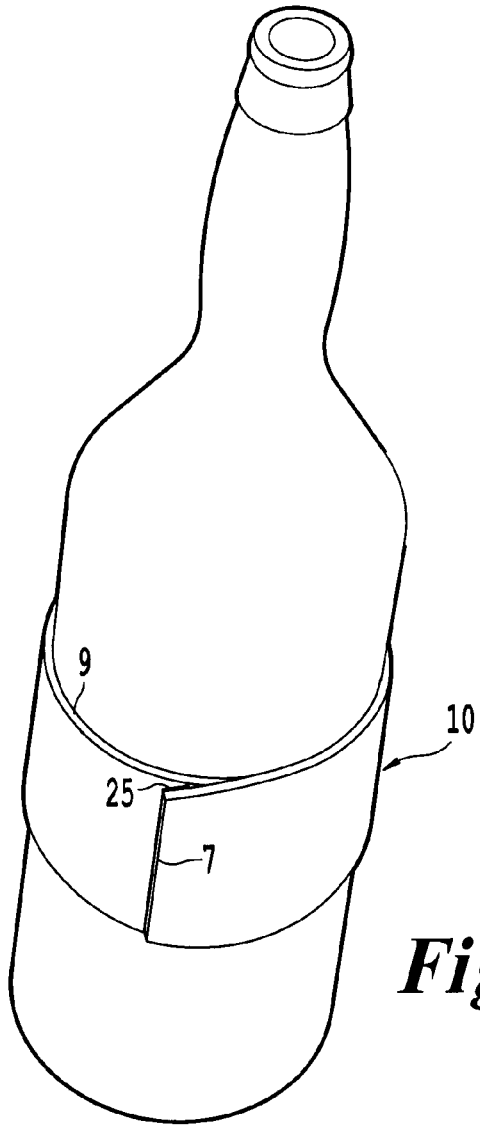
FIG. 4 is a perspective view of a beverage sleeve wrapped around a container according to an example of the invention.

As discussed above with respect to the deficiencies of the related art and various examples of the invention, an integral and fundamental aspect of the beverage sleeve 10 according to one or more embodiments of the invention, is its ability to snugly fit all drink containers. In a preferred embodiment, an advantageous feature is the use of an infinitely variable locking mechanism like VELCRO (hook and loop). In a preferred embodiment, a patch of VELCRO 25 is provided on a back surface of the beverage sleeve 10. For example, the VELCRO 25 can be laminated to the closed cell foam and/or corrugate material. When the beverage sleeve 10 is wrapped around a container, no matter what size, the VELCRO patch 25 will overlap and contact a front surface area 26 of the beverage sleeve 10, as shown in FIGS. 3 and 4. As such, the beverage sleeve 10 is infinitely variable. Since at least a portion, for example the entire, front surface of the beverage sleeve 10 is made from a material, for example loop material, that will couple with the VELCRO patch 25, for example hook material, the beverage sleeve 10 can be wrapped around the container as tight as possible and tightly secured to the container. That is, in an example of the invention, the entire front face of the beverage sleeve 10 becomes a locking mechanism to couple with the VELCRO patch 25 and allow the beverage sleeve 10 to accommodate containers of various sizes. Further, since the VELCRO patch 25 is secured to at least a portion of the area 26, the overlapped portion of the sleeve 10 does not necessarily interfere with the advertising.

In an example of the invention, the VELCRO patch 25 can be formed as a solid patch of VELCRO or can be formed as a series of relatively small dots or lines of the reciprocating part of VELCRO locking technology.

In a further example of the invention, the beverage sleeve 10 can be made of corrugate material. It should be appreciated that a combination of closed cell foam and corrugate material can be used to form the beverage sleeve 10. When the beverage sleeve 10 is made of corrugate material it is necessary to separately secure both attaching pieces of the VELCRO to a portion of the respective ends 7, 8 of the sleeve. Since the beverage sleeve 10 can securely fit around containers of various sizes, it is necessary to provide at least one of the two pieces of VELCRO as a relatively large piece so that the other piece of VELCRO can connect thereto. However, the VELCRO might need to be located in an area of the advertising. Accordingly, there are two types of VELCRO that could be used, one that would allow printing directly on the loops of the VELCRO, hence on the beverage sleeve, and one where you can not print directly on the loops, and hence have to print on the back side of the relatively clear loop material.

With respect to directly printing on the VELCRO, as discussed above, a piece of VELCRO may cover up some part of the advertising on the sleeve. Further, if to minimize costs only one size sleeve is mass produced, a percentage, for example about 25%, of the subsequently printed advertising could be affected. According to one or more examples of the invention, in order to minimize this disruption the subsequently printed advertising could be printed directly in the area of the VELCRO. As an example, one part of the VELCRO can be made clear, and therefore it can be applied subsequent to the printing of the advertising. The advertising will essentially be fully visible through the VELCRO.

A further example of the invention includes providing the loop material where one has to print the advertising on one or more surfaces of the loop material. In an example, writing, such as advertising, in the form of letters, words, and/or images is printed directly on the loop material. In an embodiment, the advertising is printed "mirror image" on the back side of the loop material, it then is immediately secured, for example glued, to the foam or corrugate material. The beverage sleeve can then be die cut out of a continuous roll. In this way, the entire manufacturing process is simplified into just printing/laminating/die cutting, and therefore clearly can be accomplished as an In Line, continuous, cost effective, process.

A further embodiment for manufacturing a beverage sleeve 10 is to print on the front of the loop material. In one example, a blank beverage sleeve 10 can be mass manufactured and the loop material can be just glued on to the closed cell foam or corrugate material and then either die cut the base material into blank beverage sleeves that could then be printed on later, or left in roll form to be both printed on and die cut later. Advantageously, by manufacturing the beverage sleeve 10 using this method potentially huge economies of scale might be achieved for the printing step should not be the slowest step of the manufacturing operation. In addition, when the advertising was printed on the beverage sleeve using this method, an appropriate printing process for the number of beverage sleeves needed for that run could be selected, which minimized costs.

In one or more examples of the invention, a singled sided corrugate material can be used that is made in a standard way, i.e., one piece of paper is folded into a "wave" shape (the corrugate), and then glued to another piece of paper (the facing paper). In a further example of the invention, at least a portion of the "facing paper" of the single faced corrugate can be replaced with loop material. The same low profile, paper like, loop material that diapers use can be used as the face paper to actually make a singled sided corrugate. This example could eliminate VELCRO application costs. Further, infinite diameter variability capability can be provided, no VELCRO will block advertising, and the smooth/soft face of the VELCRO loops would make the beverage sleeve feel good to the touch.

Further examples of the invention are discussed below that utilize corrugate material as the beverage sleeve core material. These examples include a) arrow head/fishhook concept; b) reusable/re-stickable glue stripes (like postem notes); c) slot in slot; and d) wrap around, self locking.

An example of the invention utilizes an arrow head/fishhook locking device. Advantageously, this device is relatively inexpensive as no additional materials are needed. Further, it is a simple concept to understand, and therefore one of the easiest for the public to use. Finally, this device automatically keeps both the advertising properly oriented and the sleeve snugly fit against the containers walls, regardless if the walls of that container are parallel or flared.

In the example of using re-stickable glue, cost is less of an issue because this example would add less than one cent to the cost of a beverage sleeve and therefore doesn't materially change the cost of the goods sold. Further, using re-stickable glue will permit the beverage sleeve to fit 100% of all beverage containers.

The example of slot in slot has all of the same positive attributes as the arrow head example as this device would be inexpensive and easy to use.

The example of the wrap around, self locking solution may be the cleverest locking technology, but because it requires more base material, is not initially intuitively easy to use, and can come loose during usage.

As discussed with respect to one or more embodiments of the invention, the beverage sleeve 10 can be secured to the container by a plurality of embodiments of the securing device that provides diameter variability. The overall design of the beverage sleeve 10 provides a beverage sleeve that is easy to use (intuitive to the first time user), always fits snuggly on the drink container (feels good in the users hands), and keeps the advertising appearing at a visually appealing orientation for the user and others (easy to read).

Obviously, numerous modifications and variations of the present invention are possible in light of the above teachings. It is therefore to be understood that within the scope of the appended claims, the invention may be practiced otherwise than as specifically described herein.

The invention claimed is:

1. A beverage sleeve for a container, comprising:

a first surface configured to contact the container and extend around a circumference of the container;

a second surface configured to extend around the circumference of the container and face away from the container; and a securing device to hold the sleeve to an outside surface of the container, wherein a first portion of the securing device is provided on a first end of the sleeve on the first surface and when the sleeve is held to the container, the first portion is secured to a portion of the second surface, wherein an upper surface of the sleeve is formed of a substantially continuous non-planar surface, wherein the bottom surface of the sleeve includes a central non-planar segment and a non-planar side segment located on each side of the central non-planar segment, and wherein the central non-planar segment has a first radius of curvature and the non-planar side segments each have a same second radius of curvature, wherein the first and second radius of curvatures are different from each other, wherein a radius of curvature of the upper surface of the sleeve is smaller than a radius of curvature of the central segment of the bottom surface.

2. A beverage sleeve according to claim 1, wherein the second surface includes at least one of letters and images, and wherein the second surface forms part of the securing means such that the first portion does not overlap the at least one of letters and images when the beverage sleeve is secured to the container.

3. A beverage sleeve according to claim 2, wherein a plurality of letters and/or images are printed on the second surface and at least two or more of the letters and/or images are oriented at different angles with respect to a longitudinal axis of the sleeve.

4. A beverage sleeve according to claim 3, wherein the at least one of letters and images include advertising indicia.

5. A beverage sleeve according to claim 1, wherein a main body of the beverage sleeve is formed at least in part of insulating material to protect a user's hand from beverage temperatures.

6. A beverage sleeve according to claim 5, wherein the insulating material is made from at least one of closed cell foam and corrugate material.

7. A beverage sleeve according to claim 1, wherein a center point of the radius of curvature of each of the central segment and side segments are different from each other.

8. A beverage sleeve according to claim 1, wherein a bottom edge of the side segments are substantially parallel to each other when the beverage sleeve is wrapped around a container.

9. A beverage sleeve according to claim 1, wherein the beverage sleeve includes two side edges that form substantially a right angle with respect to respective side segments of the bottom surface.

10. A beverage sleeve according to claim 1, wherein the securing device is VELCRO and the first portion of the securing device is formed of a hook layer of the VELCRO and at least a portion of the second surface of the sleeve is formed of a loop layer of the VELCRO.

11. A beverage sleeve according to claim 10, wherein the entire second surface is formed of the loop layer of the VELCRO.

12. A beverage sleeve according to claim 11, wherein the insulating material is made from closed cell foam.

13. A beverage sleeve according to claim 1, wherein the beverage sleeve is configured to securely wrap around a glass have a tapered outer circumference having a larger diameter near a top of the glass and a smaller diameter near a bottom of the glass.

14. A beverage sleeve according to claim 1, wherein a length of each of the non-planar side segments from a point adjacent the central non-planar segment to a side edge of the beverage sleeve is the same.

15. A beverage sleeve for a container, comprising:

a first surface configured to contact the container and extend around a circumference of the container;

a second surface configured to extend around the circumference of the container and face away from the container; and a securing device to hold the sleeve to an outside surface of the container, wherein a first portion of the securing device is provided on a first end of the sleeve on the first surface and when the sleeve is held to the container, the first portion is secured to a portion of the second surface, wherein an upper surface of the sleeve is formed of a substantially continuous non-planar surface, wherein the bottom surface of the sleeve includes a central non-planar segment and a non-planar side segment located on each side of the central non-planar segment, and wherein the central non-planar segment and each of the non-planar side segments have a same radius of curvature, wherein a center point of the radius of curvature of each of the central segment and side segments are different from each other, and wherein a radius of curvature of the upper surface of the sleeve is smaller than a radius of curvature of the central segment of the bottom surface.

* * * * *